United States Patent [19]

Shimoda

[11] 4,102,570

[45] Jul. 25, 1978

[54] TRANSFER TYPE COPIER

[75] Inventor: Kazuho Shimoda, Hachioji, Japan

[73] Assignee: Konishiroku Photo Industry Co., Ltd., Tokyo, Japan

[21] Appl. No.: 694,362

[22] Filed: Jun. 9, 1976

Related U.S. Application Data

[63] Continuation of Ser. No. 506,203, Sep. 16, 1974, abandoned.

[30] Foreign Application Priority Data

Sep. 19, 1973 [JP] Japan ..... 48-104873

[51] Int. Cl.[2] ..... G03G 15/00

[52] U.S. Cl. ..... 355/16; 355/3 DR

[58] Field of Search ..... 355/3 DR, 16

[56] References Cited

U.S. PATENT DOCUMENTS 3,480,361 11/1969 Doi ..... 355/16

OTHER PUBLICATIONS

IBM Technical Disclosure Bulletin, vol. 17, No. 3, Aug. 1974.

*Primary Examiner*—Monroe H. Hayes

*Attorney, Agent, or Firm*—Bierman & Bierman

[57] ABSTRACT

A transfer type copier having a rotatable drum of the type containing a long web of photosensitive material therein. The rotatable drum has a lid and a drum body, the lid being movable to permit replacement of the web and also to permit the web to be moved stepwise from inside the rotatable drum to the periphery thereof in order to position a new portion of the web on the drum body. The drum lid is movable to two positions, one of which permits the web to be removed and changed and in which the drum body is rotatable but not the lid, and the other in which the web can be moved stepwise and in which the lid remains rotatable with the drum body.

3 Claims, 8 Drawing Figures

TRANSFER TYPE COPIER

This application is a continuation of application Ser. No. 506,203 filed Sep. 16, 1974, now abandoned, which claims the priority of Japanese Patent Application No. 104873/1973 filed Sep. 19, 1973.

The present invention relates to a transfer type copier in which a long web of photosensitive medium is contained within a rotatable drum. In this type of apparatus, the photosensitive medium is brought into contact with the drum surface by unwinding a portion of it from a reel contained inside the drum. After the photosensitive medium has been used a selected number of times after which its sensitivity and contrast, amont other properties have been reduced to an undesirable level, an unused portion of the photosensitive medium is drawn out to the drum surface. The unused portion replaces the used photosensitive medium. The present invention is directed to improving the winding and mounting and exchange of the photosensitive medium.

In conventional transfer type electrophotographic copiers, the deterioration of the reproduced picture image caused by the use of the photosensitive medium for multiple copies has been prevented by selecting the number of copies the photosensitive medium is to be used for and automatically changing the photosensitive medium after the selected number of copies has been made.

In this type of copier, the copier contains a long web of photosensitive medium located within a rotatable drum. A photosensitive medium supplying reel and a photosensitive medium take up reel are journaled on shafts provided within the rotatable drum. First photosensitive medium is brought into contact with a portion of the peripheral surface of the rotatable drum by moving the photosensitive medium from the supply reel to the take up reel through the actuation of a conventional clutch or similar arrangement. Only a portion of the peripheral surface of the drum is covered by the photosensitive medium.

The peripheral surface of the rotatable drum is divided into a first portion for carrying the photosensitive medium and a second portion which is not adapted for carrying the photosensitive medium. The portion adapted to carry the photosensitive medium shall hereinafter be called the drum body. The other portion shall hereinafter be called the drum lid.

An outlet and an inlet for the photosensitive medium are provided between the drum body and the drum lid. Gaps can frequently exist between the drum body and drum lid between which the photosensitive medium is fed to the surface of the drum body. If these gaps always exist, developing powder and other dust may intrude into the drum during each use of the photosensitive medium or the process step, such as cleaning, etc. As a result, complete and overall contact between the photosensitive medium and the peripheral surface of the drum body may not be made.

Conventionally, the occurrence of the above defects has been prevented by always contacting or closely associating the drum body with the drum lid. However, in order to place a new photosensitive medium on the peripheral surface of the drum body by unwinding a new length from the supply reel to the take up reel, or when the roll of photosensitive medium on the supply reel or take up reel is attached or detached, it is necessary to detach the rotatable drum from its shaft and then to uncover the drum by swinging open the drum lid.

The drum lid is normally hinged to the drum body. Considerable operations have been needed. In such an arrangement, a rather large space is required for movement of the drum lid. Movement of the photosensitive medium on the peripheral surface of the drum as well as exchange of the roll of the used photosensitive medium with a roll of fresh photosensitive medium becomes quite complex.

Therefore, an object of the present invention is to overcome the defects in the conventional transfer type copier having a rotatable drum in which a roll of the photosensitive medium is contained.

Another object of the present invention is to provide a copier such that one can exchange a roll of used photosensitive medium within the rotatable drum with a new unused roll in convenient manner. Still another object of the present invention is to provide a copier which requires only a small space for the exchange of the roll of photosensitive medium. Still another object of the present invention is to provide a copier which allows one to easily move fresh sections of the photosensitive medium onto the peripheral surface of the rotatable drum.

Other objects and advantages of the present invention will be apparent from the following description and the accompanying drawings.

The drawings show the construction of an embodiment of the copier according to the present invention.

Figure 1:
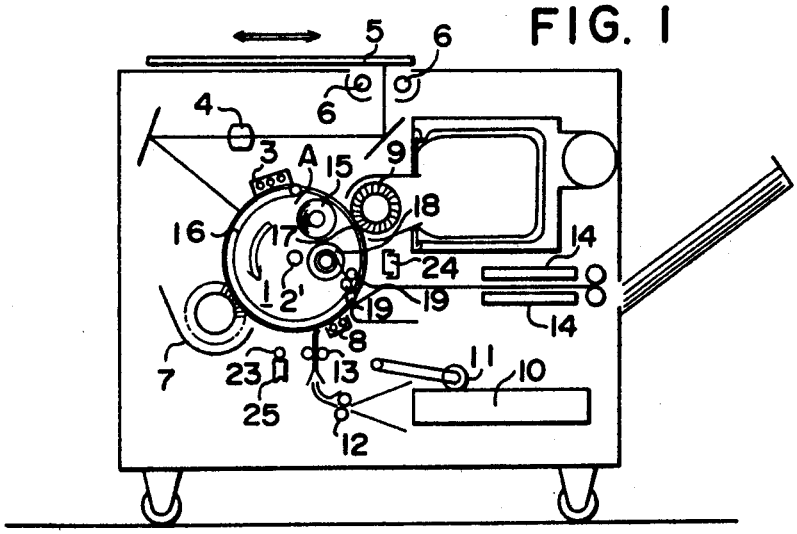
FIG. 1 is a schematic of an electrophotographic copier.
Figure 2:
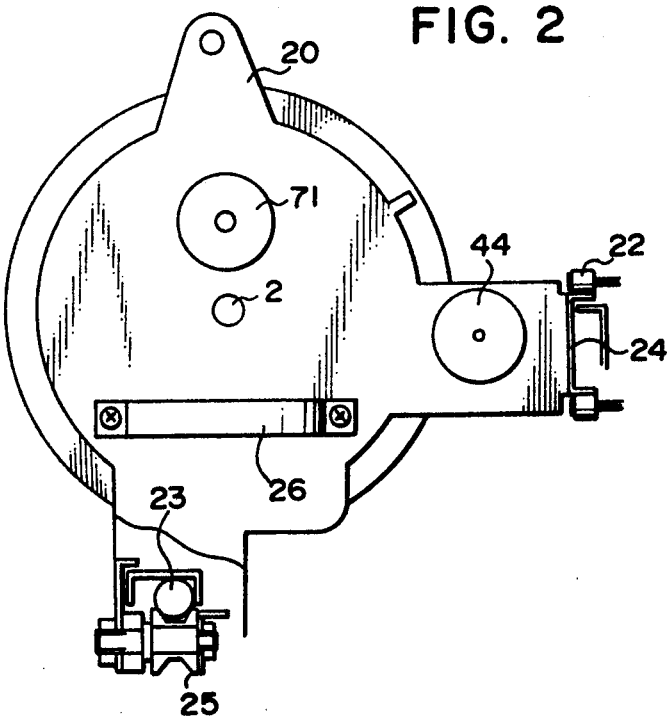
FIG. 2 is a detailed view of the drum showing the mechanism useful in drawing the rotatable drum out of the copying machine.

Referring now to FIG. 1, the operation of this kind of copier is first explained together with the schematic construction thereof. A rotatable drum 1 rotates about its rotation shaft 2 in the direction of the arrow. Around the periphery of the drum are arranged the corona charger 3 for charging photosensitive paper A, an optical system 4, an original 5 moved in synchronism with the drum 1, an illumination lamp 6, a developing device 7, a transfer electrode 8 and a cleaning device 9. The picture image recorded on the photosensitive paper A by the optical system is transferred by the transfer electrode 8 to a conventional transfer paper 10. The transfer paper 10 is transported to the peripheral surface of the drum 1 by transport rollers 11, 12 and 13. This occurs in synchronism with the rotation of the drum. After the image is conventionally transfered on to the transfer paper 10, the paper is exhausted through a conventional image fixing device 14. The photosensitive medium A is mounted on a supply reel 15 which in turn is mounted within the drum. The medium A is brought into contact with drum body 16 and is then fed through transport rollers 19 to a take up reel 18 mounted within the rotatable drum 1.

The rotation shaft 2 is integral with the drum 1 and is rotatably supported by support panels 20 and 21 provided at either end of the shaft 2. The support panels are constructed as a unitary member. Rollers 22 are mounted between the support panels 20 and 21 and ride along a channel shaped rail 24. A connecting rod 23 for connecting panels 20, 21 together is carried by guide roller 25. Therefore, the drum 1 can be drawn out toward the front of the copier frame body together with the both support panels 20 and 21.

Numeral 26 designates a drawing handle and the channel shaped rail 24 is provided with a conventional stopper (now shown) etc. for defining the amount by which the rotatable drum 1 as well as the supporting panels 20 and 21 may be drawn out.

Figure 3:
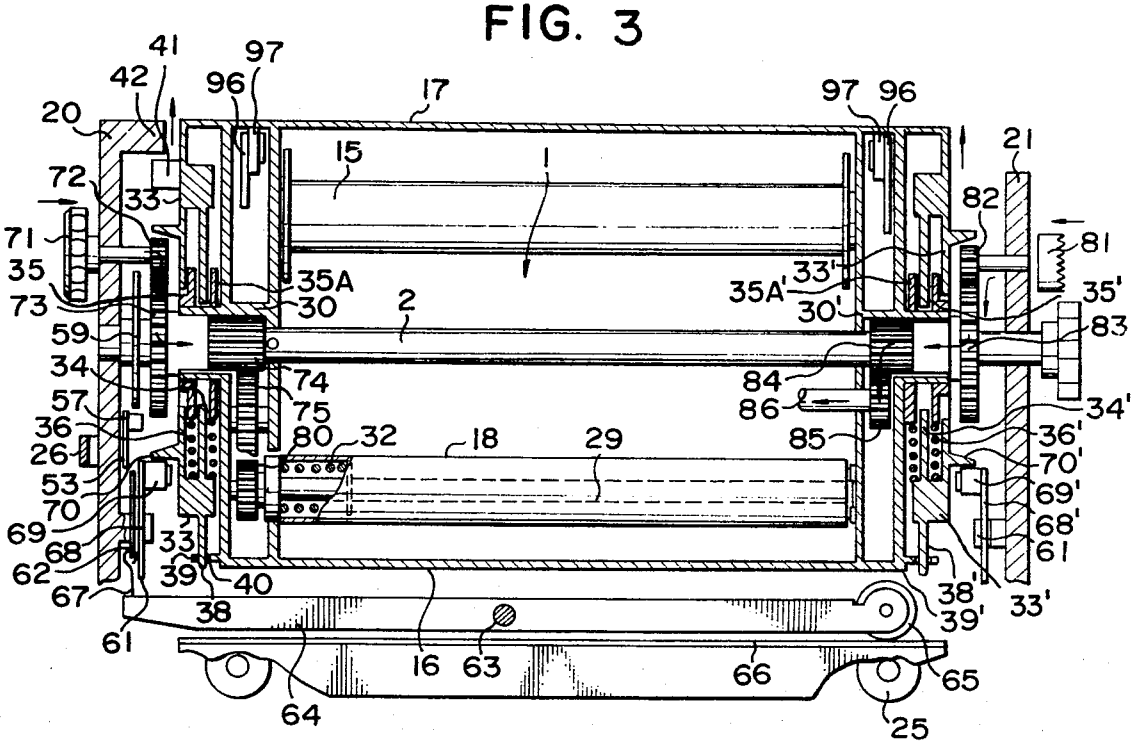
FIG. 3 is a partial cross section detailing the portion of the rotatable drum.
Figure 4:
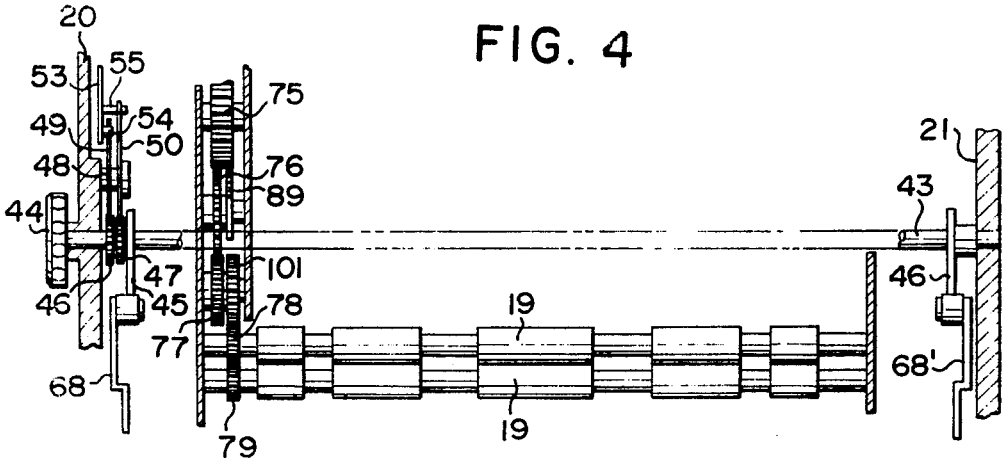
FIG. 4 is a partial cross section detailing still another part of the rotatable drum, similar to that of FIG. 3.
Figure 5:
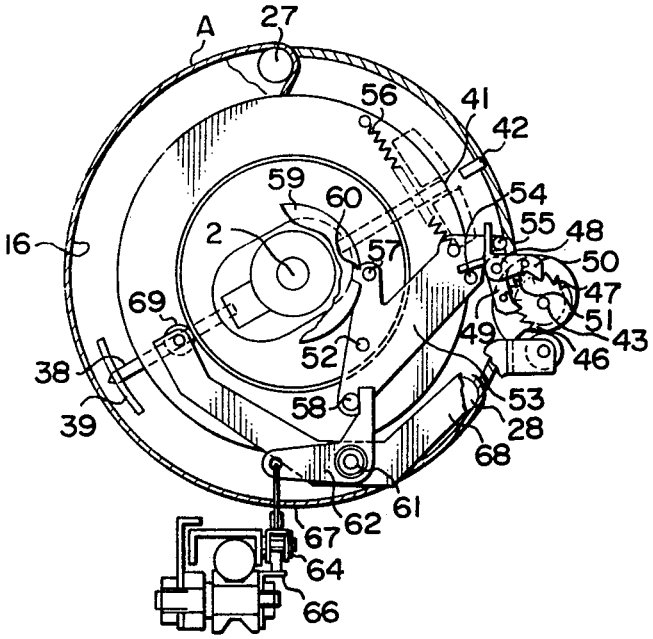
FIG. 5 is a partial view of a mechanism for floating the drum lid.

Referring now to FIGS. 3, 4 and 5, the drum 1 comprises drum flanges 30 and 30' fixedly mounted on either side of the rotation shaft 2. A drum body 16 is integral with the drum flanges. A drum lid 17 forms the upper part of the rotatable drum (FIG. 3). The photosensitive medium A is drawn out of the supply reel 15 and is brought into contact with the peripheral surface of the drum body 16 through a guide roller 27 (FIG. 5). The guide roller 27 is located between the drum body 16 and the drum lid 17. The leading end of the photosensitive medium A is passed between cooperating transport rollers 19 over a guide roller 28 (FIG. 5) mounted in an inlet slit. The leading end is then mounted on the take up reel 18 to be wound thereby. The take up reel 18 is mounted on a shaft 29 which in turn is rotatably mounted on the drum flanges 30 and 30'. The drive shaft 29 and the take up reel 18 are coupled to each other by a spring 32 interposed between them so that the photosensitive medium A can be tightly wound on the take up reel.

Rings 35, 35' are mounted on drum flanges 30, 30', respectively. The rings 35, 35' are provided with card slots 35A, 35A'. The slots accept guiding rods 34, 34' therein, as shown.

Guide rods 34, 34' are fixedly mounted to side plates 33, 33', respectively. As shown, side plates 33, 33' are an integral part of drum lid 17.

Figure 7:
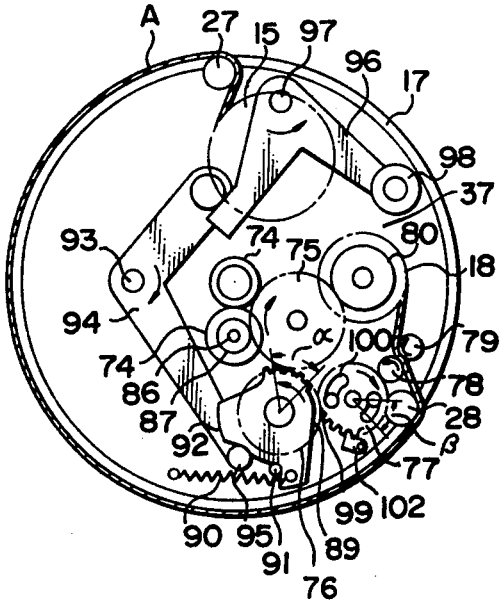
FIG. 7 is a partial view of a mechanism for floating the drum lid slightly.
Figure 8:
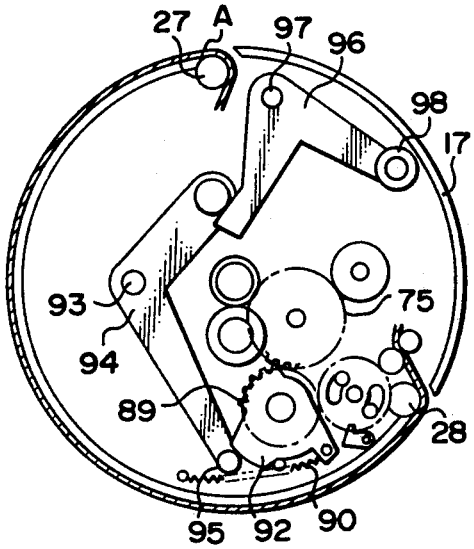
FIG. 8 shows the mechanism of FIG. 7 with the drum lid in the slightly open and floating condition.

The drum lid extends about a portion of the periphery of the rotatable drum and as most clearly seen in FIGS. 5 and 7, contacts the surface of the photosensitive medium A to hold said medium against undesired movement. Springs 36, 36' shown in FIG. 3 mounted on guiding rods 34, 34' serve to pull the drum lid 17 down towards the drum body 16 in order to contact the photosensitive medium A.

Figure 6:
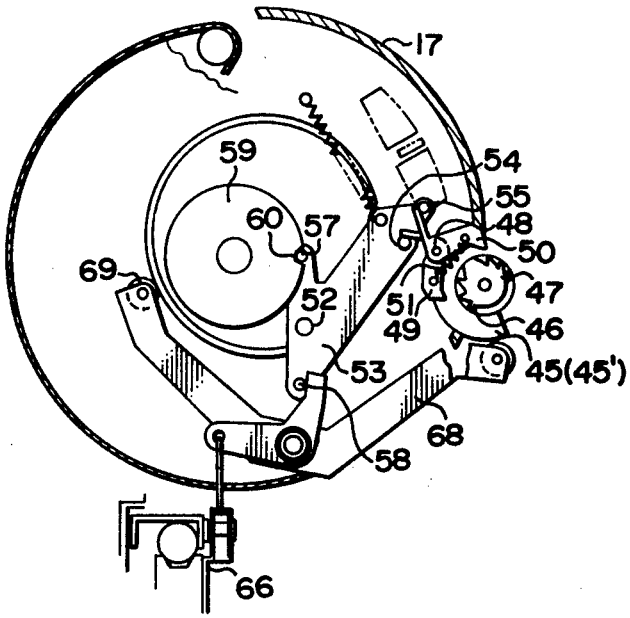
FIG. 6 shows the mechanism of FIG. 5 with a drum lid open and floating.

Rods 38 and 38' project from the side plates 33 and 33'. They are inserted into holes 40, 40' in walls 39, 39' which project from the drum body 16. The position at which the drum lid 17 blocks the opening portion 37 (FIG. 6) of the drum body 16 and rests against the photosensitive medium A is accurately defined.

The numeral 41 denotes a guide formed in the side plate 33 into which a drum lid locking projection 42 on support panel 20 is inserted when the drum lid is lifted from the drum body 16 to expose the interior of the drum.

In order to lift the drum lid 17 outward to open the opening portion 37 of the drum body 16, a shaft 43 having a knob 44 for rotating the shaft 43 is rotatably supported by the support panels 20 and 21. Two cam plates 45, 45' are mounted adjacent the respective end portions of the shaft 43. Two ratchet type stop plates 46, 47 are mounted adjacent the cam plate 45 (FIGS. 4 and 5).

Stop nails or ratchet pawls 49 and 50 are rotatably supported on a shaft 48 which in turn is mounted on the support panel 20. The ratchet pawls are adapted to engage the two stop plates 46 and 47 by a spring 51. The stop plates normally prevent rotation of the shaft 43 when the pawls are engaged.

Pins 54 and 55 are mounted on a ratchet pawl actuating lever 53 which in turn is pivotably supported by a shaft 52. The shaft 52 is mounted on the support panel 20. Pins 54 and 55 engage the rear ends of the ratchet pawls 49 and 50. The lever 53 is energized by a spring 56 toward a direction in which the ends 54 and 55 release the ratchet pawls 49 and 50 from engagement with the stop plates 46 and 47 of the shaft 43. The pin 57 on the plate 53 is adapted to engage a click slot 60 in a click disk 59 fixedly mounted to the rotation shaft 2. The lever 53 prevents rotation of the shaft 43 until the lever 53 is counterclockwise pivoted by the force of the spring 56. An L-shaped lever 62 is pivotably supported by a shaft 61 which in turn is mounted on the support panel 20. A pin 58 on lever 53 engages one end of lever 62. Lever 53 does not pivot as long as the pin 58 engages the lever 62.

The other end of the lever 62 is connected by a connecting rod 67 to one end of a lever 64 pivotably supported by a shaft 63 (FIG. 3). The shaft 63 is mounted in a support plate provided between the support panels 20 and 21. A roller 65 mounted on the other end of the lever 64 rides on a guide rail 66 (FIG. 3).

When one grasps the drawing handle 26 to draw out the rotation drum together with the support panels 20 and 21 along the channel-shaped rail 24, the lever 64 also is drawn out at the same time and the roller 65 of the rear end of the lever 64 is released from the guide rail 66 (FIG. 5). As a result, the lever 64 is rotated clockwise as seen in FIG. 3. The L-shaped lever 62 also is rotated clockwise. The ratchet pawl actuating lever 53 is rendered pivotable in the counterclockwise direction simultaneously by the energization of the spring 56 and the release of the ratchet pawls 49 and 50 from the ratchet type stop plates 46 and 47. The shaft 43 is then able to pivot.

When the rotatable drum 1 is rotated together with its rotation shaft 2 at this point, the clock disk 59 fixed to the rotation shaft 2 is also simultaneously rotated. The pin 57 of the lever 53 subjected to the energization of the spring 56 is inserted into the click slot 60 so that the ratchet pawls 49 and 50 release the ratchet type stop plates 46 and 47. Thus, when the rotation knob 44 is rotated clockwise, levers 68 and 68' are also rotated clockwise about the shafts 61 and 61' by the cams 45 and 45' fixed to the rotation knob 44. Thus, rollers 69 and 69' of the ends of the levers 68 and 68' lifts up the drum lid 17 by means of anchors 70 and 70' (FIG. 3) which project from the guide plates 33 and 33'. At this time, the drum lid locking projection 42 of the support panel 20 is inserted into the slot 41 of the drum lid and the projecting rods 38 and 38' lift out of their guide or anchoring holes 40 and 40'.

Under these conditions, only the drum body 16 remains rotatable on the shaft 2, since drum lid 17 is no longer connected to drum body 16 through guide holes 40, 40'. The opening 37 in the drum body 16 can be positioned at a most preferable position, for example, a position remote from the drum lid 17. The attachment or detachment of the photosensitive medium winding reel 18 as well as the winding of the photosensitive medium A can be achieved very easily.

In the exchange of the photosensitive medium supplying reel 15 or winding reel 18, a new supplying reel 15 or new winding reel 18, after removal of the previous one, may be mounted in the drum. The photosensitive medium A is then drawn from the supply reel 15 and is brought into contact with the drum body 16. The leading end of the photosensitive medium A is passed between the transport rollers 19 and is placed on the winding reel 18 as described earlier. When the leading end of the photosensitive medium A is interposed between the transport rollers 19 and the photosensitive medium transporting knob 17 pivotably mounted to the support panel 20 is rotated, it causes the rotation of the transport rollers 19 through a train of gears denoted by the numeral 72, 73, 74, 75, 76, 77, 78 and 79. The leading edge of medium A is then attached to the winding reel 18. The photosensitive medium A is then wound by the winding reel 18 which is rotated by gears 75 and 80.

The subsequent closing ot the drum lid 17 is carried out by operations opposite to that described above for opening the lid. Namely, the drum lid 17 is returned by the springs 36 and 36', the peripheral edge of the drum lid 17 closes firmly and sandwiches the photosensitive medium A therebetween. This provides closure of the type preventing looseness of the photosensitive medium A and undesirable intrusion of developer, dust, etc.

Description is next made with respect to movement of photosensitive medium on drum body 16 to replace used photosensitive medium with an unused portion.

To achieve this, the driving force of an L-clutch 81 provided external to the support 21 is transmitted through gears 82, 83, 84, 85, and 87 to the gear 75 to rotate the gear 80. Also, a sector-shaped gear 89 (FIG. 7) is rotatably mounted on the shaft of the gear 76. A spring 90 and a stop 91 bias gear 89 clockwise with reference to FIG. 7 and prevent rotation, respectively. Gear 76 is rotated after the intermediate gear 75 with which the gear 89 engages is rotated. If the gear 89 is counterclockwise rotated and is released from the engagement with the gear 75, the gear 89 will be maintained in this position. At this time, however, a cam portion 92 of the gear 89 causes the clockwise rotation of levers 94 and 94' through rollers 95 and 95'. The levers 94, 94' are journaled on shafts 93 and 93'. Shafts 93, 93' supported by the drum flanges 30 and 30', and the other ends of the levers 94, 94' cause the counterclockwise rotation of levers 96, 96' supported by similar shafts 97 and 97'. As a result, rollers 98 and 98' in the other ends of the levers 96 and 96' float the drum lid 17. The drum lid is slightly lifted and creates a gap through which a photosensitive medium A can freely pass.

The amount by which the drum lid 17 is thus lifted up is in the order of one-tenth of the lift used when the drum body 16 and the drum lid 17 are fully opened for replacement of the photosensitive medium. In this case, the drum body 16 does not rotate with respect to the drum 17 and the posts 38, 38' will remain engaged in guide holes 40, 40' to retain a connection between the drum body 16 and drum lid 17.

A gear 101 having an arc-like elongated slot 100 is placed on a gear 77. Pins 99 on the gear 77 engage in the slots 100. Gear 101 engages the gear 76. Lastly, gear 101 is rotatably mounted on the shaft of the gear 77. FIG. 4 shows the relative positional relationship of the gears 77 and 101.

The gear 101 engages a reverse rotation preventing stop 102. Thus, gear 101 can only rotate clockwise. The gear 101 meshes with the gear 78 of the photosensitive medium transporting roller 19 to cause the rotation of the transporting roller.

Thus, the rotation of the gear 75 results in the counterclockwise rotation of the sector-shaped gear 89 by $\alpha°$ so that the drum lid 17 is floated and maintained at the floated position. The transport roller 19 is rotated after the pin 99 has contacted the other end of the arc-like elongated slot 100 to cause the rotation of the gear 101. In the initial stage of the rotation of the gear 75, the sector-shaped gear 89 is rotated but not the gear 101. After the drum lid 17 has been floated by the rotation of the sector-shaped gear 89, the gear 101 is rotated and then the transport roller 19 is rotated to wind the photosensitive medium A.

The following equations set forth the parameters needed to achieve first floating of the drum lid and then movement of the photosensitive medium A.

$$Z_1\alpha° = Z_2\beta°$$

Here, $Z_1$ equals number of teeth of sector-shaped gear 81 in case it is provided with teeth over its entire vertical periphery, $\alpha°$ equals rotation angle of sector-shaped gear 81, $Z_2$ equals number of teeth of gear 77, $\beta°$ equals idle angle defined by the length of the arc-like elongated slot 100.

If a desired length of photosensitive medium A has been wound and operations opposite to the above-described operations are then carried out to return the drum lid 17, the copier is ready for use.

As apparent from the foregoing, in the copier according to the present invention, the shafts for carrying the roll photosensitive medium supplying reel and the roll photosensitive medium winding reel are provided within the rotatable drum. The photosensitive medium removed in the winding reel direction from the roll sensitive medium supplying reel is brought into contact with a portion of the drum periphery. After the exposed photosensitive medium has been used for a selected number of copies, an unused new portion of photosensitive medium is drawn out to the drum periphery. The peripheral surface of the rotatable drum comprises a drum body with which the photosensitive medium is brought into contact. A separate drum lid comprises the remainder of the surface and is not adapted to carry the photosensitive medium. Only the drum lid is adapted to be movable outside the rotation locus of the peripheral surface of the drum body, and upon movement of the drum lid, the drum lid is released from engagement with the rotatable drum body and is made nonrotatable by means of a fixed frame member. Only the drum body remains rotatable. In such an arrangement, even if the entire rotatable drum is drawn out to the outside of the copier frame body together with the support panels and only the drum lid is floated and stopped at the position outside of the rotation locus of the peripheral surface of the drum body portion, the drum body freely rotates so that the opening portion of the drum body portion can be utilized even if the degree of floating of the drum lid is not large. Operations such as the exchange of the roll photosensitive medium supplying reel and the roll photosensitive winding reel, and the attachment or detachment thereof, can be achieved very easily.

The invention further provides outlet and inlet slits for feeding photosensitive medium into and out of the rotatable drum. These slits are usually closed so that intrusion of toner and dust into the drum is prevented. Replacement of the photosensitive medium can be achieved quite easily.

Many modifications in and to the embodiments described above may be made by those skilled in the art. It is intended to cover all such modifications which fall within the spirit and scope of the invention as defined by the claims appended hereto.

I claim:

1. In a transfer type copier of the type having a drum rotatably mounted between a pair of side panels, and a long web of photosensitive medium mounted on supply and take-up reels within said drum in which a portion of the web is adapted to be carried on part of the peripheral surface of the drum, and means for advancing said web to move said portion back into said drum and to replace said portion with an unused portion of said web, the improvement comprising a drum lid normally engageable with the peripheral surface of said drum and forming that part of the peripheral surface of said drum which does not support said web, and in which said drum lid is movable between a first position in which said lid is connected to and rotatable with said drum and a second position in which said lid is lifted and disconnected from said drum body and not rotatable therewith, in combination with a pair of projections integral with and extending outwardly from opposite ends of said drum and each having an opening therethrough, a pair of extensions normally engageable with said openings connecting said drum lid to said drum for rotation therewith when said drum lid is in said first position, a shaft having an operating knob at one end thereof rotatably supported between said panels, and lever means actuated by rotation of said shaft for lifting said drum lid to said second position, moving it away from the periphery of said drum and disengaging said extensions from said openings, whereby said drum may be rotated independently of said drum lid.

2. The transfer type copier according to claim 1, further comprising drive means operatively connected to said second reel for rotating said second reel, said drive means being operatively connected to said drum lid for moving said drum lid to a third position slightly away from the periphery of the drum sufficient to permit the photosensitive medium to be advanced, said drum lid remaining operatively connected to said drum for rotation therewith when said drum lid is moved by said drive means to said third position.

3. In a transfer type copier of the type having a rotatable drum and a long web of photosensitive medium mounted in the drum and in which a portion of the photosensitive medium is adapted to be carried on the peripheral surface of the drum, a means for advancing said web to move said portion back into said drum and to replace said portion with an unused portion of said web, the improvement comprising a drum body, said drum body forming part of the peripheral surface of said drum, said drum body carrying said portion of said photosensitive medium; a drum lid forming substantially the remainder of the peripheral surface of said drum, said drum lid being movable between a first position in which said lid is connected to and rotatable with said drum body and a second position in which said lid is lifted and disconnected from said drum body and not rotatable with said drum body, means for connecting said drum lid to said drum body for rotation with said drum body when said drum lid is in said first position, means for lifting said drum lid to move it away from the periphery of said drum body and to said second position, and means for permitting rotation of said drum body and for preventing rotation of said drum lid when said drum lid is in its lifted position, and a guide member in said copier slidably supporting said drum between a first position in which said drum lifting means is in contact with said guide member and is inoperative, and a second position in which said drum lifting means is out of contact with said guide member and operative to move said drum lid away from the periphery of said drum; first and second reels, said first reel carrying a roll of unused photosensitive medium and said second reel carrying the used portion of said photosensitive reel.

* * * * *